United States Patent [19]

Frischknecht et al.

[11] Patent Number: 4,649,986

[45] Date of Patent: Mar. 17, 1987

[54] DEVICE FOR ADJUSTING THE WIDTH OF THE GAP BETWEEN THE ROLLS OF A CONTINUOUS CASTING FACILITY

[75] Inventors: Bruno Frischknecht, Gwatt; Rolf Würgler, Esslingen, both of Switzerland

[73] Assignee: Swiss Aluminium Ltd., Chippis, Switzerland

[21] Appl. No.: 540,779

[22] Filed: Oct. 11, 1983

[30] Foreign Application Priority Data

Oct. 18, 1982 [CH] Switzerland ..... 6069/82

[51] Int. Cl.[4] ..... B22D 11/06

[52] U.S. Cl. ..... 164/480; 72/244; 72/248

[58] Field of Search ..... 164/442, 441, 480, 428, 164/150, 154; 72/244, 248

[56] References Cited

U.S. PATENT DOCUMENTS

| | | | |
|---|---|---|---|
| 296,081 | 4/1884 | Steel | 72/244 X |
| 602,864 | 4/1898 | Matthews | 72/244 |
| 655,554 | 8/1900 | Huston | 72/244 |
| 2,108,753 | 2/1938 | Low | 164/480 |
| 3,315,511 | 4/1967 | Turner | 72/244 X |
| 3,534,577 | 10/1970 | Fernbach | 72/248 |
| 3,626,740 | 12/1971 | Hinterholzl | 72/244 |
| 4,007,822 | 2/1977 | Scheurecker | 164/448 |

FOREIGN PATENT DOCUMENTS

| | | | |
|---|---|---|---|
| 1303467 | 1/1973 | United Kingdom | 72/248 |

*Primary Examiner*—M. Jordan

*Attorney, Agent, or Firm*—Bachman & LaPointe

[57] ABSTRACT

A device for adjusting the size of the gap between casting rolls wherein the rolls are situated in bearings in supporting frames which are a variable distance apart. At least one of the supporting frames features, at its corner regions facing the other frame, bearing plates having faces inclined at an angle (w) to the axis (A) of a spindle. Moveable adjusting blocks are provided with wedge-shaped surfaces which rest against the inclined faces. Each of the adjusting blocks feature teeth which mate with threads on a spindle, the threads running counter to each other. As the spindle is rotated the blocks are moved either toward or away from each other thus raising or lowering the at least one supporting frame.

10 Claims, 1 Drawing Figure

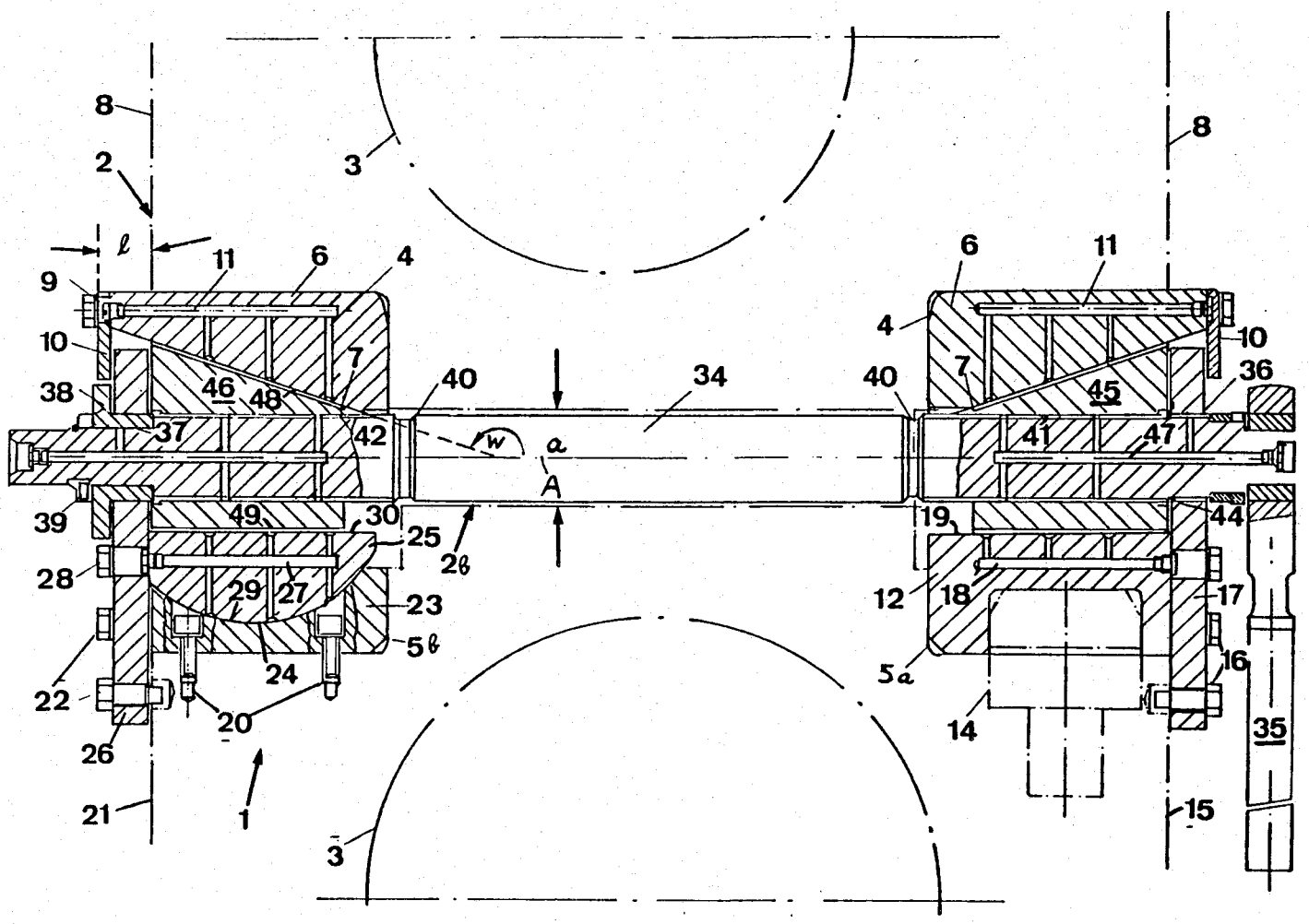
8
10
36
35
44
17
16
15
11
45
47
41
6
7
18
14
4
40
19
12
5a
34
a
A
w
40
2b
25
23
5b
3
4
7
42
30
3
6
27
24
48
46
49
29
20
1
11
37
8
2
l
9
10
38
39
28
22
26
21

DEVICE FOR ADJUSTING THE WIDTH OF THE GAP BETWEEN THE ROLLS OF A CONTINUOUS CASTING FACILITY

BACKGROUND OF THE INVENTION

The present invention relates to a process and device for adjusting the width of the gap between two rolls, in particular between the rolls of a continuous casting facility used to manufacture aluminum strips, wherein the rolls are mounted in bearings enclosed in supporting frames and wherein the distance between the frames is variable.

During the operation of roll type continuous casters it is necessary to alter the size of the gap between the casting rolls. The way of doing this is normally such that each of the rolls is mounted in bearings which are housed in special supporting frames between which spacer plates are inserted thus determining the distance between the frames and therefore also the size of the roll gap. To achieve an accurate setting, however, it is necessary to employ calibrated plates which are designed to match the different inserts. For fine adjustment of the gap it is generally necessary to employ standard gauge sheets. Correction of the roll gap during casting is completely out of the question.

Accordingly, it is the principal object of the present invention to provide a device of the kind mentioned above, which is simple and cost-wise favorable to manufacture and install in the casting facility, functions without trouble and in particular allows adjustment of the roll gap even during casting operations.

SUMMARY OF THE INVENTION

The foregoing object is achieved by way of the present invention wherein at least one supporting frame features, at its corner regions facing the other supporting frame, bearing plates having faces inclined at an angle to the axis of a spindle, and moveable adjusting blocks are provided with wedge shaped surfaces which rest against the inclined faces. In the simplest case the corner regions of the at least one frame may be inclined and adjusting blocks are inserted on both sides of the frame which is raised by means of the wedge-shaped face on the adjusting blocks. However, in the foregoing case, the edge regions on the frame would be subject to heavy wear and would make it necessary to change the whole supporting frame due to wear. It is preferred, therefore, to form an approximately rectangular recess in the corner regions of the supporting frame and to fit into the recess a bearing plate having the above mentioned inclined face. If this bearing surface becomes worn, that is, if the accuracy of the roll gap setting would suffer, then the bearing plate may be removed and replaced by a new one.

In order to achieve simultaneous movement of both adjusting blocks, and therefore uniform raising or lowering of the supporting frame each of these adjusting blocks is provided with teeth which mate with threads on the spindle, the threads at opposite ends of the spindle running counter to each other. As such, it can suffice that the adjusting blocks lie against the spindle or only partially enclose it. Preferably, however, the thread on the spindle engages with teeth inside holes bored in the adjusting blocks and the face on the opposite side from the wedge-like face of the block runs parallel to the above mentioned axis and rests against the other supporting frame. This way the movement and alignment of the block by the spindle are greatly improved.

These opposite side faces parallel to the axis slide in a corner region of the opposite lying support frame on a bearing surface of a set bolt which is likewise inserted in a corner recess in the other frame. In the opposite corner region they slide on the base surface, parallel to the axis, of the spindle, of a centering piece which in cross section has the appearance of a part of a sectioned hemisphere. The dish-shaped surface of the centering piece resides, but moveably so, in a corresponding dish-shaped recess in the supporting frame. For ease of changing when wear occurs to the surface, it is preferred to create this dish-shaped recess in a part of a block also inserted into the recess in the frame.

The spindle itself is held in bearings which are fitted into the above mentioned cover plates and, at the same time, serve as a mounting for the set bolt or part of the block and as a stop limiting the movement of the adjusting blocks.

All bearing surfaces are preferably supplied with lubricant via feed lines. This makes movement of the whole adjusting device easier and reduces wear.

The spindle can be turned by hand or by motor drive. The invention foresees the provision of a regulating facility for the spindle motor. This facility would sense the size of the roll gap, compare the actual with the intended value and activate the motor drive as required.

The device as a whole operates very economically and without interference or breaking down. It enables the roll gap to be adjusted during casting without interrupting the casting run.

BRIEF DESCRIPTION OF THE DRAWINGS

FIG. 1 is a partly sectioned front elevation of the device of the present invention.

DETAILED DESCRIPTION

A device 1 for adjusting the rolls of a roll-type continuous caster is illustrated in figure 1. Only the contours of two supporting frames 2*a* and 2*b* and roll bearings 3 of the casting facility are shown in FIG. 1. Both frames 2*a* and 2*b* are mounted at a variable distance from each other, the facing corner regions of the frames 2*a* and 2*b* featuring approximately rectangular recesses 4 and 5 to accommodate parts of the adjusting device 1.

Fitted into each of the recesses 4 is a bearing plate 6 with an outer face 7 inclined at an angle w to the axis A of spindle 34. The bearing plate 6 projects a distance l beyond the sidewall 8 of the frame 2*a*, and is such that a stop 10 is provided there at an end face 9. Running through this end face 9 and stop 10 is a channel 11 via which lubricant reaches the outer face 7 of the bearing plate 6.

Fitted into a recess 5*a* in the frame 2*b* is a tool 12 which corresponds dimensionally to recess 5*a* and is held in place by means of a setbolt 14 and cover plate 17 secured to a sidewall 15 of the frame 2*b* by attachment means 16. Running through the cover plate 17 is a feed line 18 via which lubricant passes through the tool 12 to a bearing surface 19 running approximately parallel to axis A.

Residing in the facing recess 5*b* and secured in frame 2*b* by bolts 20 and protected by a cover plate 26 mounted onto sidewall 21 by screw bolts 22, is a part of a block 23 with a dish-shaped surface 24 facing towards axis A. In this dish 24 is a movable centering piece 25 in the shape of a segment of part of a sphere. Lubricant is likewise fed through channels 27 from a source 28 on the cover plate to the curved face 29 and to the face 30 running approximately parallel to the axis A.

The parts 6, 12, 23 and 25 of the adjusting device 1 in recesses 4 and 5 are connected by a spindle 34 which can be turned around its longitudinal axis A by means of a handle 35. To this end, in each of the cover plates 17 and 26 is a bearing 36 and 37 respectively, which, in the case of cover plate 26, has the extra facility of a bearing shoe 38 against which a snap-ring 39 or the like presses to hold the spindle 34 in place.

Between the bearing points 36 and 37 and notches 40, spindle 34 features counter running threads 41 and 42 which mate with inward facing teeth, not shown, in the holes 44 provided in adjusting blocks 45 and 46. Feed lines 47 for supplying lubricant to the threads 41 and 42 and to bearing points 36 and 37 are likewise provided.

The adjusting blocks 45 and 46 lie with their wedge-shaped faces 48 on the outer faces 7 of the bearing plates 6 and with surfaces 49 parallel to axis A on the bearing surfaces 19 and 30. Consequently adjusting blocks 45 and 46 are wedge-shaped in cross section. If the spindle is turned, the adjusting blocks 45 and 46 move sliding their wedge surfaces 48 along outer faces 7 of the bearing plates 6 and faces 49 along the bearing surfaces 19 and 30, and do so either towards or away from each other thus raising or lowering the upper frame 2*a*. As a result of the movement of blocks 45 and 46 the distance a, and with that the gap between the casting rolls is adjusted.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. In a continuous casting facility used in the manufacture of strip metal, a device for adjusting the width of a gap between two opposing rolls wherein the rolls are mounted in bearings enclosed in opposed support structures, each of said support structures comprises a first and a second opposed supporting frame, said first supporting frame being provided with a pair of inclined surfaces facing said second supporting frame, a pair of adjusting blocks provided with a wedge-shaped surface positioned opposite said pair of inclined surfaces such that said wedge-shaped surface of said pair of adjusting blocks abuts said pair of inclined surfaces of said first supporting frame and means associated with said pair of adjusting blocks for moving the wedge-shaped surface of said pair of adjusting blocks relative to said pair of inclined surfaces so as to move said first supporting frame relative to said second supporting frame wherein said second supporting frame is provided with recesses into a least one of which a centering piece having a first surface which abuts the opposite side of said adjusting blocks is secured.

2. A device according to claim 1, wherein said first supporting frame are provided with recesses into which bearing plates having said inclined surfaces are secured.

3. A device according to claim 2 wherein said means for moving said adjusting blocks comprises a spindle mounted between said first and said second opposed supporting frames, said spindle being provided with at least a first thread and a second thread which run counter to each other wherein the thread mate with teeth provided on said adjusting blocks.

4. A device according to claim 3 wherein said adjusting blocks are provided with through holes having said teeth and wherein the surface of said adjusting blocks opposite said wedge-shaped surface is parallel to said spindle and abut said second supporting frame.

5. A device according to claim 1 wherein the surface of said centering piece opposite said first surface is hemispherical in shape.

6. A device according to claim 5 wherein the hemispherical-shaped surface of said centering piece rests in a movable dish-shaped recess provided in said second supporting frame.

7. A device according to claim 6 wherein the dish-shaped recess is provided in a block secured in said second supporting frame.

8. A device according to claim 7 wherein said spindle is held in bearings mounted in cover plates provided on said supporting frames.

9. A device according to claim 8 wherein said pair of inclined surfaces, said centering piece, and said threads connect up with feed lines for lubricant.

10. A device according to claim 3 wherein the threaded spindle is motor driven.

* * * * *